US010716441B2

(12) United States Patent
Zhang et al.

(10) Patent No.: US 10,716,441 B2
(45) Date of Patent: Jul. 21, 2020

(54) HANDHELD VACUUM CLEANER

(71) Applicant: TINECO INTELLIGENT TECHNOLOGY CO., LTD., Suzhou (CN)

(72) Inventors: Zhiwei Zhang, Suzhou (CN); Huaiqiang Ren, Suzhou (CN)

(73) Assignee: TINECO INTELLIGENT TECHNOLOGY CO., LTD., Suzhou (CN)

( * ) Notice: Subject to any disclaimer, the term of this patent is extended or adjusted under 35 U.S.C. 154(b) by 215 days.

(21) Appl. No.: 15/951,048

(22) Filed: Apr. 11, 2018

(65) Prior Publication Data

US 2018/0296045 A1 Oct. 18, 2018

(30) Foreign Application Priority Data

Apr. 12, 2017 (CN) ..... 2017 2 0378404 U

(51) Int. Cl.

| | |
|---|---|
| ***A47L 5/24*** | (2006.01) |
| ***A47L 9/16*** | (2006.01) |
| ***A47L 9/12*** | (2006.01) |
| *A47L 9/28* | (2006.01) |

(52) U.S. Cl.

CPC ..... *A47L 5/24* (2013.01); *A47L 9/127* (2013.01); *A47L 9/1666* (2013.01); *A47L 9/2884* (2013.01)

(58) Field of Classification Search

CPC ..... A47L 5/24; A47L 9/127; A47L 9/1666; A47L 9/2884

See application file for complete search history.

(56) References Cited

U.S. PATENT DOCUMENTS

| | | | | |
|---|---|---|---|---|
| 9,788,697 | B2 * | 10/2017 | Peace | A47L 9/165 |
| 2010/0229327 | A1 * | 9/2010 | Conrad | A47L 5/24 15/344 |
| 2010/0229335 | A1 * | 9/2010 | Conrad | A47L 5/24 15/412 |
| 2010/0251506 | A1 * | 10/2010 | Conrad | A47L 9/1625 15/344 |

(Continued)

FOREIGN PATENT DOCUMENTS

| | | | | |
|---|---|---|---|---|
| DE | 102011083449 | A1 * | 3/2013 | A47L 9/1683 |

*Primary Examiner* — Marc Carlson

(74) *Attorney, Agent, or Firm* — Maschoff Brennan

(57) ABSTRACT

A handheld vacuum cleaner, mainly comprising a main body and a dust collection accessory, wherein the main body comprises a housing (3) and a dust cup (8), a dust collection pipe (1) is provided on the dust cup, a motor (2), a battery pack (7) and a handle (6) are provided above the dust cup, a cyclone filter (81) is provided within the dust cup, an inlet filter sponge component (9) and an inlet strainer component (10) provided around the periphery of the inlet filter sponge component are arranged within the cyclone filter, a dust cup base cover (85) is provided at the bottom of the dust cup, an opening (851) is provided on the dust cup base cover, and the inlet filter sponge component is directly mounted or removed at the bottom of a dust cup. An inlet filter sponge component of the present invention can be directly withdrawn from the bottom of a dust cup so that a user does not need to disassemble a dust cup when replacing and cleaning, which effectively ensures the performance of a motor and improves user's convenience to the maximum extent as well.

9 Claims, 2 Drawing Sheets

(56) References Cited

U.S. PATENT DOCUMENTS

| | | | | |
|---|---|---|---|---|
| 2013/0160233 | A1* | 6/2013 | Peace | A47L 9/1625 15/353 |
| 2014/0137364 | A1* | 5/2014 | Stickney | A47L 5/24 15/347 |
| 2019/0343356 | A1* | 11/2019 | Kim | A47L 9/242 |

* cited by examiner

HANDHELD VACUUM CLEANER

CROSS-REFERENCE TO RELATED APPLICATION

This application claims the benefit of priority to Chinese Patent Application No. ZL201720378404.3, filed Apr. 12, 2017. The disclosure of the above-referenced application is incorporated herein by reference.

TECHNICAL FIELD

The present invention relates to a handheld vacuum cleaner and belongs to the field of small home appliance.

BACKGROUND

Chinese patent with the publication No. CN205107554U discloses a handheld cleaning device, in which a motor is provided at the side of a dust cup filter, and the shaft axis of the motor air inlet and the axis of the dust cup filter are coaxial or axially parallel. The device compresses product volume to the maximum extent, which is advantageous for the extension of the rear outlet pipe of the motor and the arrangement of the rear outlet filtering system of the motor, and is advantageous for the prevention of secondary pollution and noise problems. However, the motor in this equipment is arranged above the dust cup filter, and thus there is insufficient room to hold the front filter sponge of the motor between the motor and the dust cup filter. Therefore, in this structure, the residual dust that cannot be effectively filtered by the dust cup filter may enter the motor directly, which can have a great impact on the performance and life of the motor.

SUMMARY OF THE INVENTION

A technical problem to be solved by the present invention is to provide a handheld vacuum cleaner with regard to the deficiency in the prior art. In the handheld vacuum cleaner of the present invention, an inlet filter sponge component can be directly withdrawn from the bottom of a dust cup so that a user does not need to disassemble the dust cup when replacing and cleaning the inlet filter sponge component, thus effectively ensuring the performance of the motor and improving user's convenience to the maximum extent as well.

The present invention solves the technical problem by implementing the following technical solution:

a handheld vacuum cleaner, comprising a main body and dust collection accessories connected thereto, wherein the main body comprises a housing and a dust cup associated with the housing. A dust collection pipe is provided on the dust cup for connecting the dust collection accessories to the main body. A motor is provided above the dust cup. A battery pack for powering the motor is provided on the housing. A handle is provided at one side of the housing, A cyclone filter is provided within the dust cup. An inlet filter sponge component and an inlet strainer component around the periphery of the inlet filter sponge component are arranged within the cyclone filter. A dust cup base cover with an opening is provided at the bottom of the dust cup. The inlet filter sponge component can be directly mounted or removed at the bottom of a dust cup via the opening.

To facilitate sealing, a rubber ring for sealing and positioning at an inner edge of the opening is provided at the bottom of the inlet filter sponge component. The rubber ring comprises a first sealing part clamping with the inner edge of the opening and a second sealing part sealing an inner wall of the inlet strainer component.

The inner edge of the opening is provided with a rubber ring for sealing and positioning at the bottom of the inlet filter sponge component.

In particular, the inlet filter sponge component comprises of an inlet filter sponge and an inlet filter holder, wherein the inlet filter sponge is provided around the inlet filter holder, and the inlet filter holder is fixed within the cyclone filter.

To facilitate dust collection, the inlet filter sponge component and the cyclone filter are coaxial or axially parallel to each other. Further, the motor is arranged on an axial extension line of the inlet filter sponge component.

To achieve better dust collection effect, the inlet filter sponge component and the inlet strainer component are coaxially arranged.

According to the present invention, the inlet filter sponge component and the inlet strainer component extend longitudinally within the dust cup, with an upper end thereof extending to an air inlet of the motor and a lower end extending to the bottom of the dust cup.

More specifically, the inlet strainer component consists of an inlet strainer and an inlet strainer holder.

In addition, to facilitate sealing after the filter sponge component is removed, a sealing ring for sealing the dust cup is provided at the bottom of the inlet strainer component.

In summary, the present invention provides a handheld vacuum cleaner, in which an inlet filter sponge component can be directly withdrawn from the bottom of a dust cup so that a user does not need to disassemble a dust cup when replacing and cleaning an inlet filter sponge component, thus effectively ensuring the performance of a motor and improving user's convenience to the maximum extent.

The technical solution of the present invention is described in detail below in conjunction with the accompanying drawings and specific embodiments.

DETAILED DESCRIPTION

Figure 1:
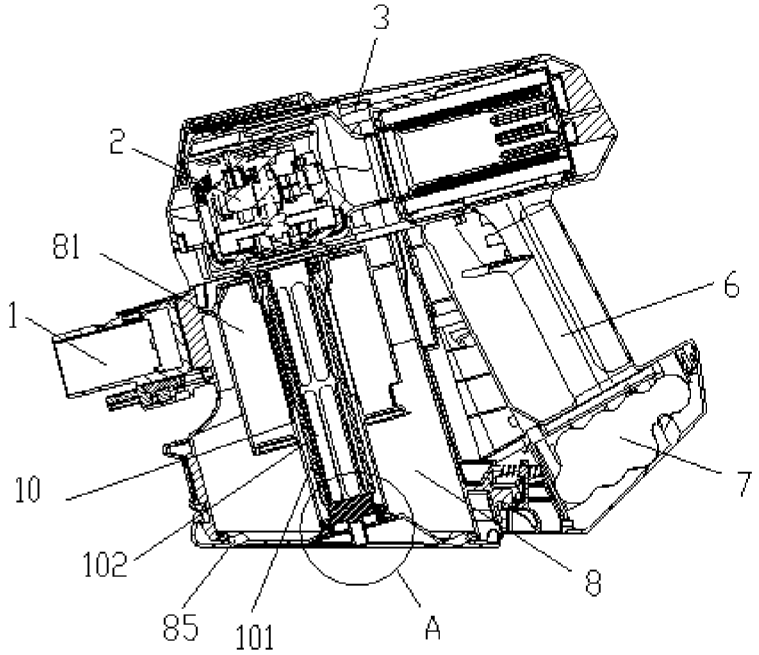
FIG. 1 is an overall structural schematic diagram of a main body of the present invention.
Figure 2:
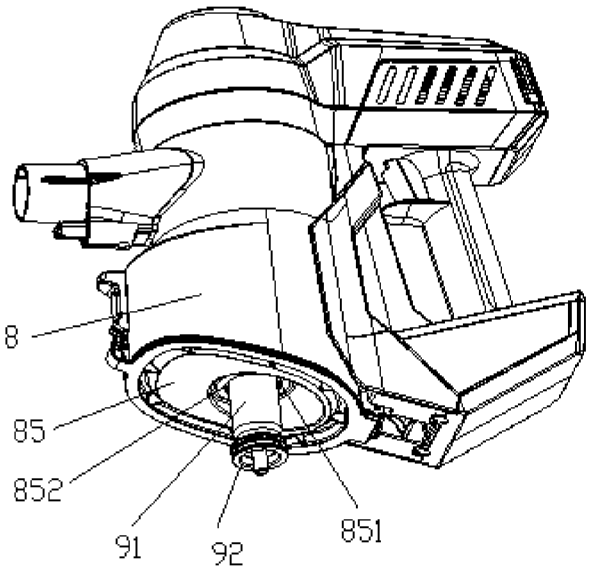
FIG. 2 is a sectional view of the present invention.
Figure 3:
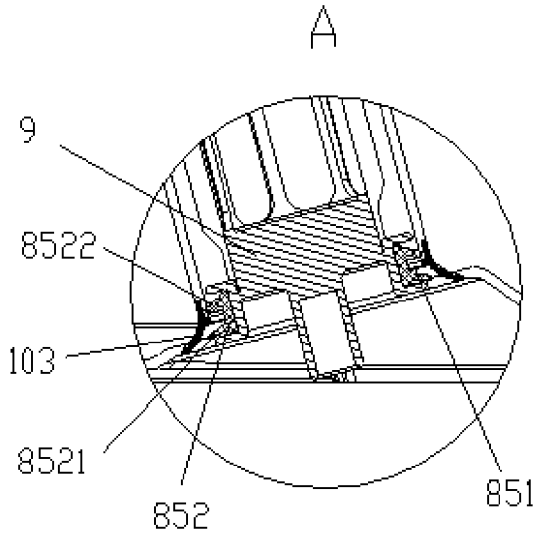
FIG. 3 is an enlarged drawing of part A of FIG. 2.

FIG. 1 is an overall structural schematic diagram of a main body of the present invention. FIG. 2 is a sectional view of the present invention. FIG. 3 is an enlarged drawing of part A of FIG. 2.

As shown in FIG. 1, FIG. 2 and FIG. 3, the present invention provides a handheld vacuum cleaner, comprising a main body and dust collection accessories connected thereto (not shown in the figure). The main body comprises a housing 3 and a dust cup 8 connected to the housing. A dust collection pipe 1 is provided on the dust cup for connecting the dust collection accessory to the main body. A motor 2 is provided above the dust cup 8, a battery pack 7 for powering the motor is provided on the housing, and a handle 6 is provided at one side of the housing. A cyclone filter 81 is provided within the dust cup, and an inlet filter sponge component 9 and an inlet strainer component 10 provided around the periphery of the inlet filter sponge component 9 are arranged within the cyclone filter. A dust cup base cover 85 with an opening 851 is provided at the bottom of the dust cup. The inlet filter sponge component 9 can be directly mounted or removed at the bottom of a dust cup via the opening 851.

Figure 4:
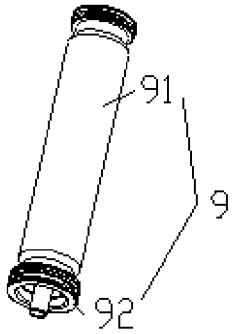
FIG. 4 is a structural schematic diagram of an inlet filter sponge component of the present invention.

FIG. 4 is a structural schematic diagram of an inlet filter sponge component of the present invention. As shown in FIG. 4, the inlet filter sponge component 9 comprises an inlet filter sponge 91 and an inlet filter holder 92. The inlet filter sponge 91 is arranged around the inlet filter holder 92, and the inlet filter holder is fixed within the cyclone filter 81.

As shown in FIG. 1 and FIG. 2, to facilitate dust collection, the inlet filter sponge component 9 and the cyclone filter 81 are coaxial or axially parallel to each other. Further, the motor 2 is arranged on an axial extension line of the inlet filter sponge component 9. To achieve better dust collection effect, the inlet strainer component 10 is further provided outside the inlet filter sponge component 9. The inlet filter sponge component 9 and the inlet strainer component 10 are coaxially arranged. In particular, the inlet filter sponge component 9 and the inlet strainer component 10 extend longitudinally within the dust cup 8, with an upper end thereof extending to an air inlet of the motor and a lower end extending to the bottom of the dust cup. Further on, the inlet strainer component 10 comprises an inlet strainer 101 and an inlet strainer holder 102.

As shown in FIG. 2 and FIG. 3, a rubber ring 852 for sealing and positioning at the bottom of the inlet filter sponge component 9 is provided at an inner edge of the opening 851. The rubber ring 852 comprises a first sealing part 8521 clamping with the inner edge of the opening 851 and a second sealing part 8522 sealing an inner wall of the inlet strainer component 10. In addition, to facilitate sealing after the filter sponge component 9 is removed, a sealing ring 103 for sealing the dust cup 8 is provided at the bottom of the inlet strainer component 10.

As shown in FIG. 1 to FIG. 4, the working process of the present invention is as follows:

when the vacuum cleaner is in operation, dust tangentially enters the cyclone filter 81 at a high speed along with air flow via the dust collection pipe 1. The high-speed rotating air flow effectively centrifugalizes most of the dust particles which are then sent from the dust cyclone filter 81 to the dust cup dust storage chamber. The centrifugalized air flow in the cyclone filter 81 enters the inlet strainer component 10, which comprises an inlet strainer 101 and an inlet strainer holder 102. The construction of the inlet strainer 101 is generally known in to the prior art, and its construction can be nylon braided mesh, metal braided mesh or metal etching mesh. After passing through the inlet strainer component 10, the air flow which may include very small amount of dust freely flow to the inlet filter sponge component 9. The characteristic of the inlet filter sponge component 9 is that it can effectively intercept dust particles, so that clean air passes through the inlet filter sponge 91 and before it enters the motor 2. At the same time, because of the arrangement of the opening 851 on the dust cup base cover 85, it is possible to directly remove the inlet filter sponge component 9 from the bottom of the dust cup 8 without additionally removing the dust cup 8 or opening the dust cup base cover 85. This not only provides great convenience for the users, but also prevents secondary pollution due to the need to open the dust cup. It effectively ensures the performance of the motor, improves user's convenience to the maximum extent, and gives full play to the advantages of the handheld vacuum cleaner.

In summary, the present invention provides a handheld vacuum cleaner which can effectively filter the air flow entered a motor without changing the location layout of the motor in the handheld vacuum cleaner whereby an inlet filter sponge component is arranged inside a cyclone filter to improve the filtering effect of the vacuum cleaner and at the same time, the inlet filter sponge component can be directly withdrawn from the bottom of a dust cup. Thus a user does not need to disassemble a dust cup when replacing and cleaning an inlet filter sponge component. This effectively ensures the performance of a motor and improves user's convenience to the maximum extent as well.

The invention claimed is:

1. A handheld vacuum cleaner, comprising:

a main body; and a dust collection accessory connected thereto, wherein:

the main body includes a housing and a dust cup associated with the housing, a dust collection pipe is provided on the dust cup for connecting the dust collection accessory to the main body, a motor is provided above the dust cup, a battery pack for powering the motor is provided on the housing, a handle is provided at one side of the housing, a cyclone filter is provided within the dust cup, an inlet filter sponge component and an inlet strainer component provided around the periphery of the inlet filter sponge component are arranged within the cyclone filter, a dust cup base cover is provided at the bottom of the dust cup, an opening is provided on the dust cup base cover, and the inlet filter sponge component can be directly mounted or removed at the bottom of a dust cup via the opening.

2. The handheld vacuum cleaner of claim 1, wherein:

a rubber ring for sealing and positioning at an inner edge of the opening is provided at the bottom of the inlet filter sponge component, and the rubber ring comprises a first sealing part clamping with the inner edge of the opening and a second sealing part sealing an inner wall of the inlet strainer component.

3. The handheld vacuum cleaner of claim 2, wherein:

the inlet filter sponge component consists of an inlet filter sponge and an inlet filter holder, the inlet filter sponge is provided around the inlet filter holder, and the inlet filter holder is fixed within the cyclone filter.

4. The handheld vacuum cleaner of claim 3, wherein the inlet filter sponge component and the cyclone filter are coaxial or axially parallel to each other.

5. The handheld vacuum cleaner of claim 3, wherein the motor is arranged on an axial extension line of the inlet filter sponge component.

6. The handheld vacuum cleaner of claim 1, wherein the inlet filter sponge component and the inlet strainer component are coaxially arranged.

7. The handheld vacuum cleaner of claim 6, wherein the inlet filter sponge component and the inlet strainer component extend longitudinally within the dust cup, with an upper end thereof extending to an air inlet of the motor and a lower end extending to the bottom of the dust cup.

8. The handheld vacuum cleaner of claim 7, wherein the inlet strainer component consists of an inlet strainer and an inlet strainer holder.

9. The handheld vacuum cleaner of claim 7, wherein a sealing ring for sealing the dust cup is provided at the bottom of the inlet strainer component.

* * * * *